US010378270B2

(12) United States Patent
Lambertini

(10) Patent No.: US 10,378,270 B2
(45) Date of Patent: Aug. 13, 2019

(54) SASH FOR DOORS OR WINDOWS

(71) Applicant: GO TECHNOLOGY S.R.L., Vilanova di Castenaso (Bologna) (IT)

(72) Inventor: Marco Lambertini, San Lazzaro di Savena (IT)

(73) Assignee: GO TECHNOLOGY S.R.L., Fraz. Villanova (IT)

( * ) Notice: Subject to any disclaimer, the term of this patent is extended or adjusted under 35 U.S.C. 154(b) by 0 days.

(21) Appl. No.: 15/761,680

(22) PCT Filed: Sep. 20, 2016

(86) PCT No.: PCT/IB2016/055598
§ 371 (c)(1),
(2) Date: Mar. 20, 2018

(87) PCT Pub. No.: WO2017/051307
PCT Pub. Date: Mar. 30, 2017

(65) Prior Publication Data

US 2018/0347260 A1 Dec. 6, 2018

(30) Foreign Application Priority Data

Sep. 21, 2015 (IT) ..... 102015000053575

(51) Int. Cl.
*E06B 3/66* (2006.01)
*E06B 3/44* (2006.01)
*E06B 3/50* (2006.01)

(52) U.S. Cl.
CPC ..... *E06B 3/6617* (2013.01); *E06B 3/44* (2013.01); *E06B 3/50* (2013.01); *E05Y 2900/132* (2013.01); *E05Y 2900/148* (2013.01)

(58) Field of Classification Search
CPC .... E06B 3/5427; E06B 3/6617; E06B 3/6621; E06B 3/66304; E06B 3/44
See application file for complete search history.

(56) References Cited

U.S. PATENT DOCUMENTS 4,961,975 A * 10/1990 Bejnar ..... E06B 3/5427 156/109
RE35,149 E * 1/1996 Richardson ..... A47F 3/043 49/501

(Continued)

FOREIGN PATENT DOCUMENTS

CN 103741872 A 4/2014
DE 29812574 U1 11/1998

(Continued)

OTHER PUBLICATIONS

International Search Report and Written Opinion dated Nov. 8, 2016 for counterpart PCT Application No. PCT/IB2016/055598.

(Continued)

*Primary Examiner* — Christine T Cajilig
(74) *Attorney, Agent, or Firm* — Shuttleworth & Ingersoll, PLC; Timothy J. Klima

(57) ABSTRACT

A sash for doors or windows includes two spaced apart glass sheets, a spacer element interposed between the sheets to define a closed inner perimeter zone and an open outer perimeter zone. A structural sealing/adhesion component runs along the outer perimeter zone and occupies a volume to permit contact with the spacer element and the glass sheets. An element for housing accessory components for supporting and/or operating the sash is associated with the structural component for each side of the glass sheets. Each element includes a rigid profile having, in cross section, at least one closed base side and two flaps each formed by a stretch perpendicular to the base side and a recessed stretch, parallel to the base side, to form a channel with an opening The rigid profile is associated with the structural component along the outer surface of the base side.

9 Claims, 3 Drawing Sheets

(56) References Cited

U.S. PATENT DOCUMENTS

| | | | | | |
|---|---|---|---|---|---|
| 5,584,143 | A * | 12/1996 | Kennedy | A47F 3/043 | 49/492.1 |
| 8,464,467 | B2 * | 6/2013 | Lambertini | E06B 3/025 | 49/316 |
| 2002/0056184 | A1 * | 5/2002 | Richardson | A47F 3/0434 | 29/458 |
| 2011/0308169 | A1 * | 12/2011 | Lambertini | E06B 3/025 | 49/417 |

FOREIGN PATENT DOCUMENTS

| | | | | | |
|---|---|---|---|---|---|
| DE | 102012215297 | A1 * | 3/2014 | E06B 3/5427 | |
| EP | 0228641 | A2 | 7/1987 | | |
| EP | 0381646 | A1 * | 8/1990 | A47F 3/043 | |
| EP | 0937856 | A2 * | 8/1999 | E06B 3/025 | |
| EP | 0937856 | A2 | 8/1999 | | |
| EP | 2315900 | A1 | 5/2011 | | |
| EP | 2628883 | A2 * | 8/2013 | E06B 3/6621 | |
| EP | 2722473 | A2 | 4/2014 | | |
| EP | 2546448 | A3 | 11/2014 | | |
| FR | 2572766 | A1 | 5/1986 | | |
| FR | 2572766 | A1 * | 5/1986 | E06B 3/025 | |
| WO | WO-9802632 | A1 * | 1/1998 | B32B 17/10036 | |
| WO | 9816711 | A1 | 4/1998 | | |
| WO | WO2010097776 | A1 | 9/2010 | | |
| WO | WO-2016150712 | A1 * | 9/2016 | E06B 3/5878 | |

OTHER PUBLICATIONS

Italian Search Report dated Mar. 7, 2016 for counterpart Italian Application No. IT UB20153774.

Chinese Office Action dated Nov. 5, 2018 for counterpart Chinese Patent Application No. 201680054706.3

International Search Report and Written Opinion dated Nov. 30, 2016 for counterpart PCT Application No. PCT/IB2016/055624

Italian3 Search Report dated Mar. 7, 2016 for counterpart Italian Application No. IT UB20153763.

Lambertini—U.S. Appl. No. 15/761,666, filed Mar. 20, 2018.

Chinese Office Action dated Nov. 5, 2018 for counterpart Chinese Patent Application No. 201680054614.5.

* cited by examiner

SASH FOR DOORS OR WINDOWS

This application is the National Phase of International Application PCT/IB2016/055598 filed Sep. 20, 2016 which designated the U.S.

This application claims priority to Italian Patent Application No. 102015000053575 filed Sep. 21, 2015, which application is incorporated by reference herein.

TECHNICAL FIELD

This invention relates to a sash for doors or windows.

More specifically, this invention is used for a sash for tilt or turn doors or windows.

BACKGROUND ART

In the technical field relative to the formation of sashes for doors and windows, the design comprises two essential components: the so-called double glazing unit and the supporting frame for the double glazing unit and the functional accessories relating to the correct assembly and use of the sash formed.

Usually, the double glazing unit comprises:

- at least a pair of sheets of glass (with equal or different perimeter dimensions according to the planned use) positioned facing each other and parallel to each other
- a spacer and joining element positioned on the four sides formed by the sheets of glass;
- a structural component made of synthetic material applied along the outer perimeter defined by the spacer in order to increase the physical characteristics of the double glazing unit formed and also to increase the thermal insulation of the chamber present between the two sheets of glass and the seal to moisture.

The frame which mounts the double glazing comprises:

- a pair of uprights and crosspieces made of a metallic material associated with the edges of the double glazing unit to form the supporting frame of the double glazing unit;
- each of the uprights and the crosspieces has a tubular profile shaped to define accessory zones for application of seals and at least one longitudinal channel for applying functional elements (for example, hinges) or elements for operating/closing the sash such as slidable rods or striker elements.

This frame interacts with the fixed counterframe applied to the opening of the room in which the sash is mounted. The fixed counterframe has a profile and accessories which share the accessories present on the frame of the sash.

This type of, so-called, traditional sash structure, even though functionally reliable, has limits of an aesthetic, assembly time and costs and thermal sealing type.

For these reasons, attempts have been made, over time, to modify the basic structures to obtain better results in terms of appearance, rationalisation of frame components and thermal sealing characteristics.

Examples of prior art solutions which are able to modify the structure of the sash frame are known from patent documents EP2315900 and EP2722473 (in the name of the same Applicant as this invention) wherein the frame is without uprights and crosspieces and the perimeter edges of the sheets of glass (forming a cavity) are used to house only the tubular parts of the metal profile useful for applying the supporting and operating accessories and the sash closing/opening accessories associated with the sheets of glass.

Another prior art solution is described in patent document FR 2572766 wherein the frame consists of a hybrid rubber-metal structure.

In other words, a rubber block is housed inside the cavity of the double glazing unit (associated on both sides only to the inner part of the sheets of glass) equipped with a shaped seat which houses, at least partially, in slidable coupling mode (before assembly on the double glazing unit) a complete metal profile configured to define both the seats for housing the control and operating accessories and the lateral actuation accessories such as a handle which are connected by subsequent machining on one of the sheets of glass and on the rubber.

Another solution is known in the prior art from patent document EP 937.856 wherein a frame structure is associated with an inner surface of one of the sheets of glass. The frame comprises a first lower half-chamber supporting the operating components and a second tubular chamber designed to guarantee the passage of the screws for fixing the operating components.

The frame is located asymmetrically and rests fully on the largest sheet of glass with the relative adhesive glue, whilst the other side, the difference in distance is compensated by a greater use of structural component and/or glue.

This embodiment of a sash has the drawback of reduced structural sealing; the frame is asymmetrical and has two different tubularities so it does not represent a structural component with mechanical sealing for the pair of sheets of glass and can be used only on pairs of sheets of glass of different dimensions, that is, with reduced adaptation to frames of different dimensions and types of opening.

Another prior art solution is described in patent document DE 298 12 574 U1. In this solution there are two different profiles, one for each inner side of the glass, each glued to the surface of the glass. The upper portion of the two profiles protrudes towards the centre of the compartment where there is a thermal break seal in contact on both sides with the two portions of the profile. Moreover, the two profiles form an outer supporting surface for the hardware and a half-tubularity designed to allow the passage of fixing screws of the central hardware which are able to reach the central seal thanks to its suitable shaping in the central portion.

This solution, like the previous one, is also a solution with a frame of reduced structural seal; the frame is, in effect, in two parts which are separate and in direct contact with the corresponding sheets of glass. The structure of this frame can only be used on pairs of sheets of glass with different dimensions, that is, with reduced adaptation to frames of different dimensions and opening types.

All these solutions, although they are a considerable improvement with respect to the structure of the traditional sash, have still not eliminated some and further drawbacks, such as weight of the sash, reduction in component and assembly costs and, also, the possibility of adapting the sash to fixed counterframes which are already mounted.

There is currently a greatly felt need for the adaptability of the sash also to counterframes already present since it would drastically reduce the replacement costs without involving invasive and awkward works in closed environments.

DISCLOSURE OF THE INVENTION

This invention has for an aim to provide a door or window sash that overcomes the above mentioned disadvantages of the prior art.

More specifically, the aim of this invention is to provide a sash for doors or windows which is able to maintain the operational reliability of the traditional type sashes combined with a good appearance.

A further aim of this invention is to propose a sash for doors or windows with a reduced weight and number of components and which is able to be made in a simple and inexpensive manner.

These aims are fulfilled by the sash for doors or windows according to the present disclosure.

More specifically, the sash for doors or windows comprises a first and a second sheet of glass positioned facing each other and parallel to each other at a mutual distance.

The sash also comprises a spacer and joining element interposed between two inner surfaces facing each other of the two sheets of glasses to define a first closed inner perimeter zone or chamber and a second open outer perimeter zone or cavity for each side defined by the pair of sheets of glass.

The sash also comprises a structural sealing/adhesion component applied along the outer perimeter defined by the cavity.

The structural component occupies a volume of the cavity which is able to allow contact of the structural component at least with the spacer element and with a part of the inner surfaces of the two sheets of glass.

According to the invention, the sash also comprises at least an element for housing accessory components for supporting and/or operating the sash associated with the structural component, for each side defined by the first and second sheet of glass.

Again according to the invention, each element is comprised of a rigid profile having, in cross section, at least one closed base side and two flaps each formed by a stretch perpendicular to the base side and a recessed stretch, parallel to the base side, to form a channel with an opening.

Again according to the invention, the rigid profile is associated with the structural component at least along the outer surface of the base side.

This sash structure allows an extremely high quality standard to be obtained, both from a technical and aesthetic point of view.

In addition, the times and costs for making this sash are extremely reduced, whilst maintaining high levels of sealing and functionality.

Again according to the invention, the rigid profile comprises at least one anchoring rib projecting from the outer surface of the base side and immersed in the structural component.

The presence of the ribbing on the rigid profile allows the mechanical seal of the sash to be increased considerably, even in the presence of large sheets of glass.

BRIEF DESCRIPTION OF DRAWINGS

This and other features will become more apparent from the following description of a preferred embodiment of the invention, illustrated by way of non-limiting example in the accompanying tables of drawings, in which.

DETAILED DESCRIPTION OF PREFERRED EMBODIMENTS OF THE INVENTION

Figure 1:
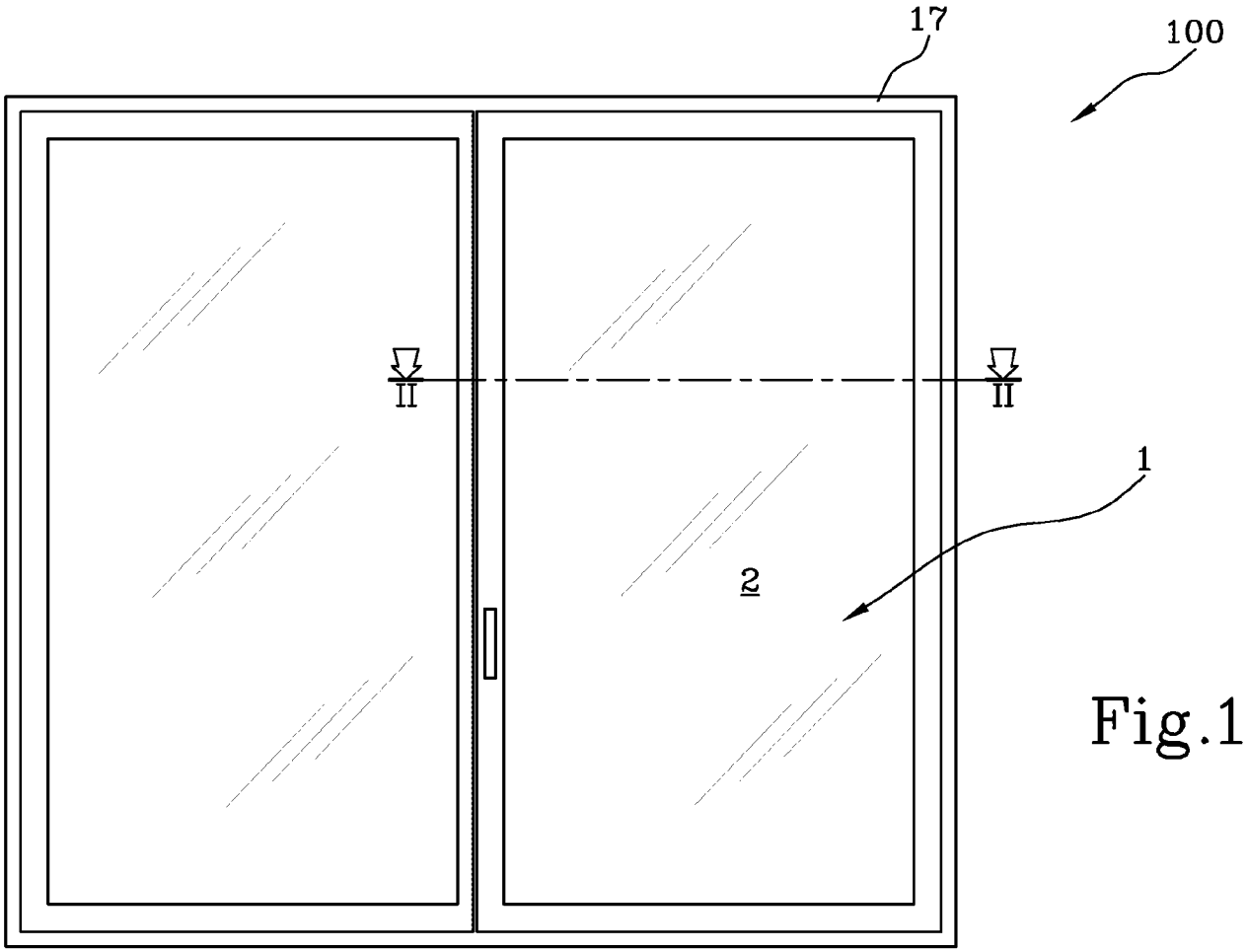
FIG. 1 illustrates a schematic front view of a window obtained with the sash for doors or windows according to this invention.

With reference to the accompanying drawings, and with particular attention to FIG. 1, the sash according to the invention, labelled 1 in its entirety, is used for making doors or windows 100 with opening by turning or by turning and tilting and with single or double sash configurations.

The doors or windows 100 of particular interest comprise a fixed frame 17 (here only partly illustrated) on which the sash 1 is articulated by hinges (not illustrated).

The sash 1 may, therefore, rotate about a vertical axis and also (in the case of tilting movements) about a horizontal axis to move from a closed position to an open and vice versa.

The sash 1, as described below, is equipped with control and operating components to allow the opening and closing configurations.

The sash 1 for doors or windows comprises (see FIGS. 2 to 4) at least a first 2 and a second 3 sheet of glass positioned facing each other and parallel to each other at a mutual distance D.

The sash 1 also comprises a spacer and joining element 4 interposed between two inner surfaces 2*a*, 3*a* facing each other of the two sheets of glasses 2, 3 to define a first closed inner perimeter zone or chamber 5 and a second open outer perimeter zone or cavity 6 for each side defined by the pair of sheets of glass 2, 3 (in this example there are four sides).

Again, the sash 1 comprises a structural sealing/adhesion component 7 applied along the outer perimeter defined by the cavity 6.

In light of this, the structural component 7 occupies a volume P of the cavity 6 which is able to allow contact of the structural component 1 at least with the spacer element 4 and with a part of the inner surface 2*a*, 3*a* of the two sheets of glass 2, 3.

According to the invention, the sash 1 also comprises at least an element 8 for housing accessory components 9*a*, 9*b*, 9*c*, 9*d* for supporting and/or operating the sash 1 associated with the structural component 7, for each side defined by the first and second sheet of glass 2, 3.

Again according to the invention, each element 8 is comprised of a rigid profile having, in cross section, at least one closed base side 9 and two flaps 10 and 11 each formed by a stretch 12 transversal to the base side 9 and a recessed stretch 13, parallel to the base side 9, to form a channel (in the form of a rotated "C") with an opening 14.

Preferably, the transversal stretch 12 is positioned perpendicular to the base side 9.

Also according to the invention, the rigid profile is associated with the structural component 7 at least along the outer surface of the base side 9.

It should be noted that the structural component 7 has sealing characteristics to allow a greater seal of the inner chamber 5 and adhesion characteristics to increase the mechanical characteristics of the double glazing unit formed.

Preferably, each cavity 6 present on the corresponding double glazing structure formed, has a single rigid profile 8 (single piece) extending for the entire length of the side.

According to the invention (see FIGS. 2 and 3), the rigid profile 8 comprises at least one anchoring rib 15 projecting from the outer surface of the base side 9 and immersed in the structural component 7.

In light of this, the anchoring rib 15 has, in cross section, a form of a keel extending with its vertex towards the spacer element 4.

This rib 15 allows the mechanical seal to be increased between the structural component 7 and the rigid profile 8 in order to guarantee a system for supporting the accessory components 9*a*, 9*b*, 9*c*, 9*d* which is extremely safe.

It should be noted that the anchoring rib 15 is immersed completely in the structural component 7 for an extension at least equal to half of a thickness defined by the structural component 7 (inside the cavity 6).

In light of this, the anchoring rib 15 has the respective longitudinal axes of extension positioned perpendicular relative to the base side 9 of the housing element 8.

It should be noted that the anchoring rib 15 has a profile provided with a tubular chamber 16 to define a form of keel with a partly wedge-shaped cross section of extension.

Thanks to this rib 15 a sort of "structural wall" is obtained which connects, stiffening, the two sheets of glass 2 and 3 by means of the portions of structural component 7 interposed between each sheet of glass and the rib 15.

In light of this, the anchoring rib 15 has the relative contact base with the base side 9 of the housing element 8 with a width at least equal to a third of the length of the base side 9.

All these structural and dimensional features are such that the housing element 8 and rib 15 combine considerable operating flexibility with structural safety of the sash.

Moreover, the simplicity of the solution makes it possible to adapt this structure to any type of the sash with the same or different sheets of glass (as described in more detail below) and with any type of movement (sash, tilt and turn, etc.)

In a first embodiment (FIG. 2), the rigid profile 8 is associated with the structural component 7 in a position equally spaced from the two sheets of glass 2, 3, that is, in a central position referred to the width of the cavity 6 corresponding to the distance D between the two sheets of glass 2, 3.

In a second embodiment (FIG. 3), the rigid profile 8 is associated with the structural component 7 in a position asymmetrical relative to the two sheets of glass 2, 3, that is, in a position which is off centre with respect to the width of the cavity 6 corresponding to the distance D between the two sheets of glass 2, 3.

These two different embodiments make it possible to adapt both the different configurations of double glazing units (as described below) and the various profiles forming the fixed frames 17 so as to be able to correctly position the channel of the rigid profile 8 relative to the channel with which the fixed frame 17 is equipped (see FIGS. 2 and 3).

Figure 2:
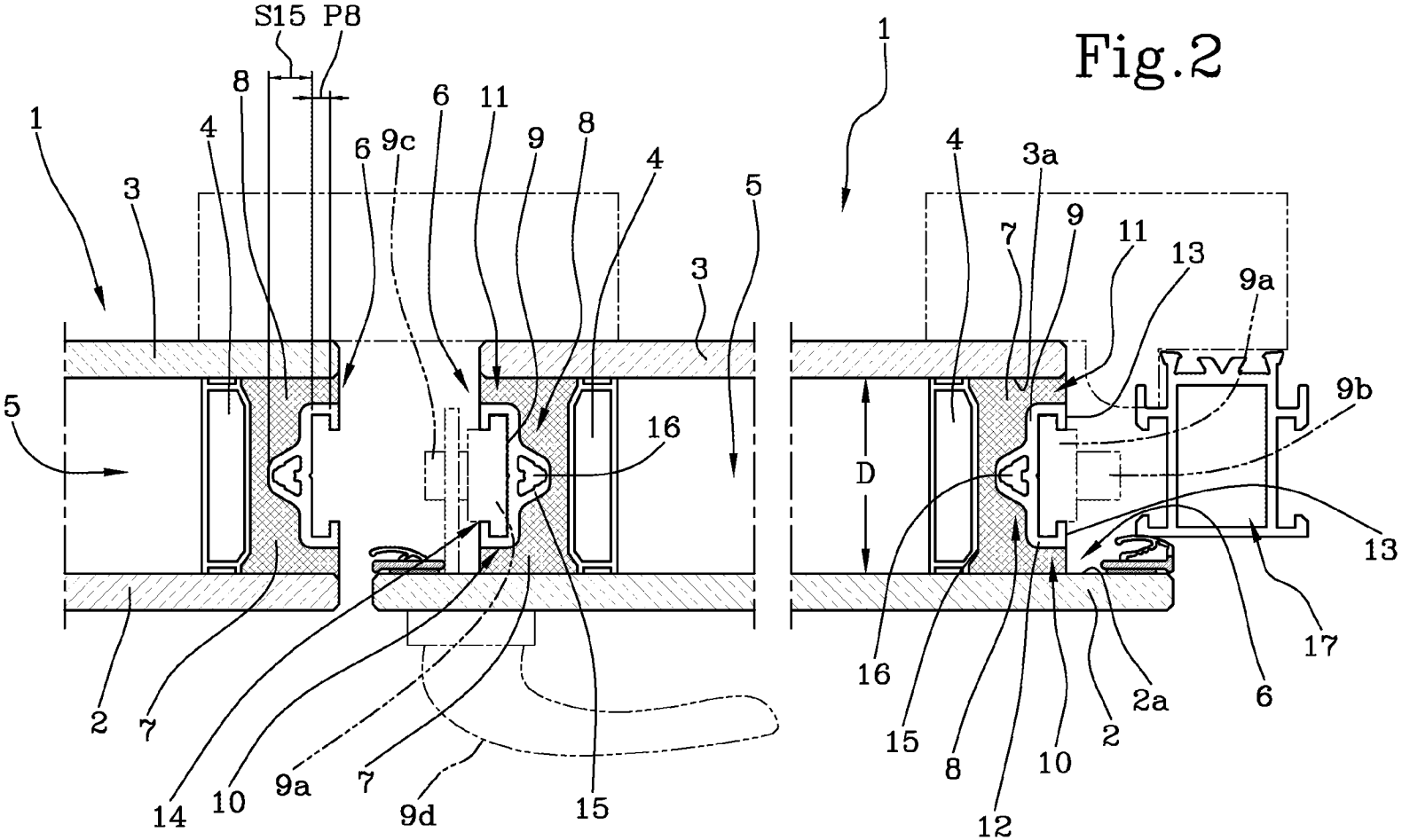
FIG. 2 is a cross-section through line II-II, referred to FIG. 1, of a first embodiment of a sash for doors or windows according to the invention, with some parts cut away.

In the embodiment illustrated in FIG. 2, the rigid profile 8 is immersed in the structural component with the base side 9 and the stretches 12, 13 of the flaps 10 and 11 perpendicular to the base side 9 in such a way as to only keep the opening 14 free facing towards the outside of the cavity 6.

The various embodiments illustrated in prior art must, as mentioned, also adapt to different configurations of the sheets of glass 2, 3 forming the double glazing unit.

In FIG. 2, the first pick-up unit 2 and the second 3 sheet of glass have different perimeter dimensions.

In this solution, the structural component 7 occupies a partial volume of the cavity 6 which is able to cover the part of the cavity 6 between the inner surfaces 2*a*, 3*a* facing each other of the two sheets of glass 2, 3 until they are coplanar with the free end of the sheet of glass 3 with smaller dimensions.

In this situation, the rigid profile 8 is positioned coplanar with the free end of the sheet of glass 3 with smaller dimensions. More specifically, it is positioned coplanar with the free end of the sheet of glass 3 with smaller dimensions of the opening 14 of the rigid profile.

As illustrated in FIG. 2, in this configuration of the sash 1, the rigid profile 8 is immersed in the structural component with the base side 9 and the stretches 12, 13 of the flaps 10 and 11 perpendicular to the base side 9 in such a way as to only keep the opening 14 free facing towards the outside of the cavity 6.

In light of this, the rigid profile 8 may be, preferably, but not necessarily, positioned centrally in the cavity 6.

Figure 3:
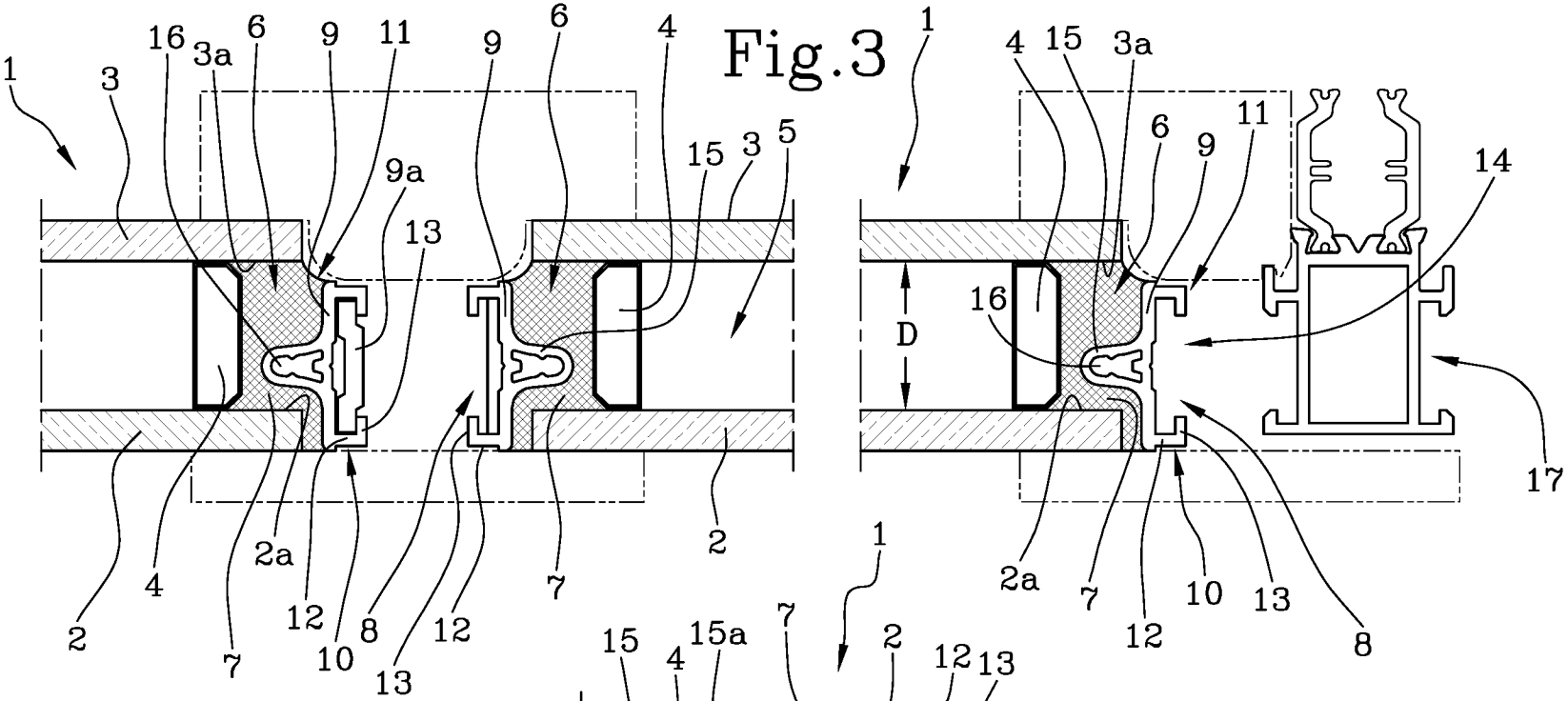
FIG. 3 is a cross-section through line II-II, referred to FIG. 1, of a second embodiment of a sash for doors or windows according to the invention, with some parts cut away.

In FIG. 3, the first 2 and the second 3 sheet of glass have equal perimeter dimensions.

In this solution, the structural component 7 occupies the entire volume of the cavity 6 defined.

It should be noted that the structural component 7 in this configuration may protrude from the cavity 6 until wrapping around at least one of the ends of the two sheets of glass 2 or 3.

In light of this, the rigid profile 8 is positioned protruding from the cavity 6.

More specifically, the rigid profile 8, preferably is, but not necessarily, positioned off-centre relative to the cavity 6. In light of this, the rigid profile 8 is positioned with partial overlapping of a free end of one of the sheets of glass 2, 3 wrapped in the structural component 7.

It should be noted that the rib 15 of the rigid profile 8 has an extension S15 calculated from the outer surface of the base side 9 at least greater than the depth P8 of the channel defined by the flaps 10, 11 of the rigid profile 8.

Figure 4:
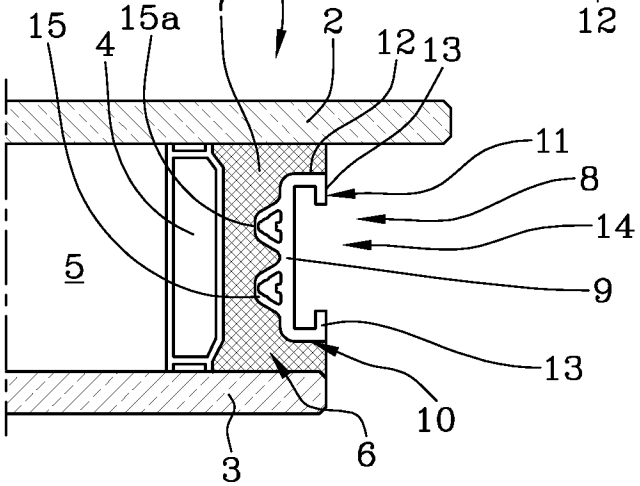
FIG. 4 illustrates a schematic cross section of a detail of a third embodiment of the sash.

According to a further alternative embodiment illustrated in FIG. 4, the rigid profile 8 comprises at least two ribs 15, 15*a* protruding from the outer surface of the base side 9.

In light of this, the two ribs 15, 15*a* are located side by side and immersed in the structural component 7 to allow an increase in the mechanical sealing characteristics of the rigid profile.

As already mentioned, the channel of the rigid profile 8 houses operating components such as an operating rod 9*a* (see dashed line in FIG. 2 and solid line in FIG. 3) which are slidable inside the channel.

The operating rod 9*a* may be associated, for example, to constraining elements 9*b* such as bosses (see FIG. 2) interacting with striker elements constrained to the fixed frame 17 (not illustrated herein).

Elements 9*c* for constraining the rod 9*a* are applied on the rod 9*a* for connecting with a control handle 9*d* located outside the sash 1.

It should also be noted that the anchoring rib 15 can be used, thanks to the tubular chamber 16, as component which is able to partly house fixing elements of further structural components or angular fixing accessories between the vertical side and the horizontal side of the sash.

The present aims are fully achieved with a sash structured in this way.

The sash has an extremely reduced number of components and, consequently, a fast and easy assembly with a reduction in overall costs.

Moreover, this structure makes it possible to adapt the sash to many types of fixed frames without having to change any type of component.

The constructional simplicity of this sash also allows a fast replacement of more complex sashes, whilst maintaining unaltered the mechanical strength and thermal sealing characteristics.

The invention claimed is:

1. A sash for doors or windows, comprising:

a first and a second sheet of glass positioned facing each other and parallel to each other at a spaced distance;

a spacer and joining element interposed between two inner surfaces facing each other of the first and second sheets of glass to define a first closed inner perimeter zone or chamber and a second open outer perimeter zone or cavity for each side defined by the first and second sheets of glass;

a structural component for sealing/adhesion applied along an outer perimeter defined by the second open outer perimeter zone or cavity; the structural component occupying a volume of the second open outer perimeter zone or cavity to allow contact of the structural component at least with the spacer and joining element and with a part of the two inner surfaces of the first and second sheets of glass, a housing element for housing accessory components for at least one chosen from supporting and operating the sash, the housing element connected to the structural component, for each side defined by the first and second sheets of glass; each housing element including a rigid profile having, in cross section, at least one closed base side and two flaps, each formed by a transversal stretch transversal to the base side and a recessed stretch, parallel to the base side, to form a channel with an opening; the channel configured to house an operating rod which is slidable inside the channel; the rigid profile being connected to the structural component at least along an outer surface of the base side;

the rigid profile comprising at least one anchoring rib projecting from the outer surface of the base side and immersed in the structural component; the anchoring rib having, in cross section, a keel extending with a vertex towards the spacer and joining element;

wherein the at least one anchoring rib includes a profile with a tubular chamber to define the keel with a partly wedge-shaped cross section.

2. The sash according to claim 1, wherein the at least one anchoring rib is immersed completely in the structural component for an extension at least equal to half a thickness defined by the structural component; the at least one anchoring rib having a longitudinal axis of extension positioned perpendicular relative to the base side of the housing element.

3. The sash according to claim 1, wherein the rigid profile is arranged with respect to the structural component in a position equally spaced from the first and second sheets of glass, in a central position referenced to a width of the second open outer perimeter zone or cavity corresponding to the spaced distance.

4. The sash according to claim 1, wherein the rigid profile is arranged with respect to the structural component in a position asymmetrical relative to the first and second sheets of glass, in a position which is off center with respect to a width of the second open outer perimeter zone or cavity corresponding to the spaced distance.

5. The sash according to claim 1, wherein the rigid profile is immersed in the structural component with the base side and the transversal stretches to keep the opening free towards an outside of the second open outer perimeter zone or cavity.

6. The sash according to claim 1, wherein the first and second sheets of glass have equal perimeter dimensions, and wherein the structural component occupies the volume of the second open outer perimeter zone or cavity and the rigid profile is positioned to protrude from the second open outer perimeter zone or cavity.

7. The sash according to claim 1, wherein the first and second sheets of glass have different perimeter dimensions, and wherein the structural component occupies a partial volume of the second open outer perimeter zone or cavity to cover a part of the second open outer perimeter zone or cavity between the two inner surfaces to be coplanar with a free end of one of the first and second sheets of glass with smaller dimensions; the rigid profile also being positioned coplanar with the free end.

8. The sash according to claim 1, wherein the at least one anchoring rib includes an extension calculated from the outer surface of the base side at least greater than a depth of the channel defined by the two flaps of the rigid profile.

9. The sash according to claim 1, wherein the at least one anchoring rib includes two anchoring ribs protruding from the outer surface of the base side.

* * * * *